US005282423A

United States Patent [19]

Sikorski et al.

[11] Patent Number: 5,282,423

[45] Date of Patent: Feb. 1, 1994

[54] MODULAR PROPELLANT CHARGE

[75] Inventors: Günter Sikorski, Düsseldorf; Albert Schulze, Mönchengladbach; Eckhard Rahnenführer, Dormagen; Dieter Grabner, Willich; Frank Achilles, Schnaittach, all of Fed. Rep. of Germany

[73] Assignee: Rheinmetall GmbH, Dusseldorf, Fed. Rep. of Germany

[21] Appl. No.: 917,383

[22] Filed: Jul. 23, 1992

[30] Foreign Application Priority Data

Jul. 25, 1991 [DE] Fed. Rep. of Germany ..... 4124657

[51] Int. Cl.[5] ..... F42B 5/18

[52] U.S. Cl. ..... 102/431; 102/282; 102/317; 102/331; 102/443; 102/700

[58] Field of Search ..... 102/282, 317, 331, 373, 102/430, 431, 432, 433, 443, 700

[56] References Cited

U.S. PATENT DOCUMENTS

| | | | |
|---|---|---|---|
| 2,574,830 | 11/1951 | Howell | 102/317 |
| 2,687,093 | 8/1954 | Botts | 102/317 |
| 3,176,617 | 4/1965 | Brafford | 102/282 |
| 3,508,518 | 4/1970 | Flynn | 102/334 |
| 4,063,508 | 12/1977 | Whiting | 102/393 |
| 4,702,167 | 10/1987 | Reinelt et al. . | |
| 4,705,655 | 11/1987 | Maures et al. | 102/431 |
| 4,854,238 | 8/1989 | Vaice | 102/371 |
| 5,160,804 | 11/1992 | Wahner et al. | 102/443 |

FOREIGN PATENT DOCUMENTS

| | | | |
|---|---|---|---|
| 1074761 | 10/1954 | France | 102/331 |

OTHER PUBLICATIONS

PCT WO89/04453, Rahnenfuhrer et al, May 1989.

*Primary Examiner*—Harold J. Tudor

*Attorney, Agent, or Firm*—Spencer, Frank & Schneider

[57] ABSTRACT

A modular propellant charge (10) composed of N propellant charge modules (1; 11-16) each having a length Lo. In order to obtain an economical, durable, easily released connection between the propellant charge modules (1; 11-16), a displaceable sleeve (6; 17-22) of a length L is axially slidably arranged on the exterior of each propellant charge module (1; 11-16) with the relationship $$Lo > L > \frac{N-1}{N} Lo$$

applying for the length L. The displaceable sleeves are utilized to interconnect adjacent modules.

6 Claims, 2 Drawing Sheets

MODULAR PROPELLANT CHARGE

BACKGROUND OF THE INVENTION

The present invention relates to a modular propellant charge composed of a number of similar propellant charge modules.

Propellant charges composed of several identical modules are required primarily for larger caliber weapons systems (for example, for howitzers, etc.). The individual modules generally have the shape of a cylinder and frequently have a length to diameter ratio of about one. An axial opening is provided to enable the charge to fire through upon ignition.

Such a modular propellant charge is disclosed, for example, in German Utility Model Patent 70/00,615. Here the individual propellant charge modules have unilaterally arranged sleeve-like extensions into which the respective next module can be plugged to form the modular propellant charge. The drawback of such arrangements is primarily the large volume required due to the projecting sleeves and the necessarily directional loading of the propellant charge magazine.

German Patent 3,034,360.A1 discloses a modular propellant charge in which the individual modules are connected with one another via a bayonet closure. For this purpose, the modules are provided with two tubular extensions, with the one tubular extension being provided with bores and the second tubular extension with a corresponding number of outwardly projecting radial pins. This arrangement is also relatively voluminous and requires directional loading of the magazines.

Finally, German Patent 3,737,704.A1 discloses a modular propellant charge in which the individual propellant charge modules are of symmetrical construction. On its two sides facing the adjacent modules, each propellant charge module is provided with constrictions that are connected with one another by means of a separate plug-in ring. The drawback of this arrangement is the relatively complicated manipulation and the additional space required for the plug-in rings.

SUMMARY OF THE INVENTION

It is an object of the present invention to provide an economical and space saving connection between the propellant charge modules, as well as a connection that is durable and absorbs the forces generated during manual manipulation of the propellant charge (transport, loading, etc.). The connection between the modules additionally must be easily separable when required.

The above objects are generally achieved by the present invention by a modular propellant charge which comprises: a plurality of cylindrical axially aligned propellant charge modules having a length Lo; a plurality N of displaceable sleeves of a length L, each slidably disposed on the exterior surface of at least one of the propellant charge modules with the relationship $$Lo > L > \frac{N-1}{N} Lo$$

applying for the length L; and each adjacent pair of charge modules is connected together via a respective one of the sleeves which extends over the exterior surface of each of the modules of an adjacent pair.

According to further features of the invention, facing end surfaces of adjacent said sleeves are in contact with one another and one of the sleeves extends to an end surface of the modular propellant charge. Moreover, the displaceable sleeves are composed of a combustible material, preferably as wound sleeves.

According to a preferred embodiment, each propellant charge module includes a foamed propellant charge surrounded by a casing of a combustible material, with the casing preferably being a wound member of the combustible material.

The above object is achieved according to a further aspect of the invention by a cylindrical propellant charge module for a modular propellant charge composed of a plurality of interconnected propellant charge modules of similar shape and size, which module comprises: a cylindrical propellant charge having a length Lo and an axial through bore; and an axially displaceable sleeve disposed on an outer circumferential surface of the propellant charge module for connecting the module to an adjacent module, with the sleeve having a length L with the following relationship $$Lo > L > \frac{N-1}{N} Lo,$$

where N is an integer greater than 1 and corresponds to the maximum number of modules to be interconnected to form a modular propellant charge.

Further details and advantages will be described below with reference to an embodiment of the invention and the drawing figures.

DETAILED DESCRIPTION OF THE DRAWINGS

Figure 1:
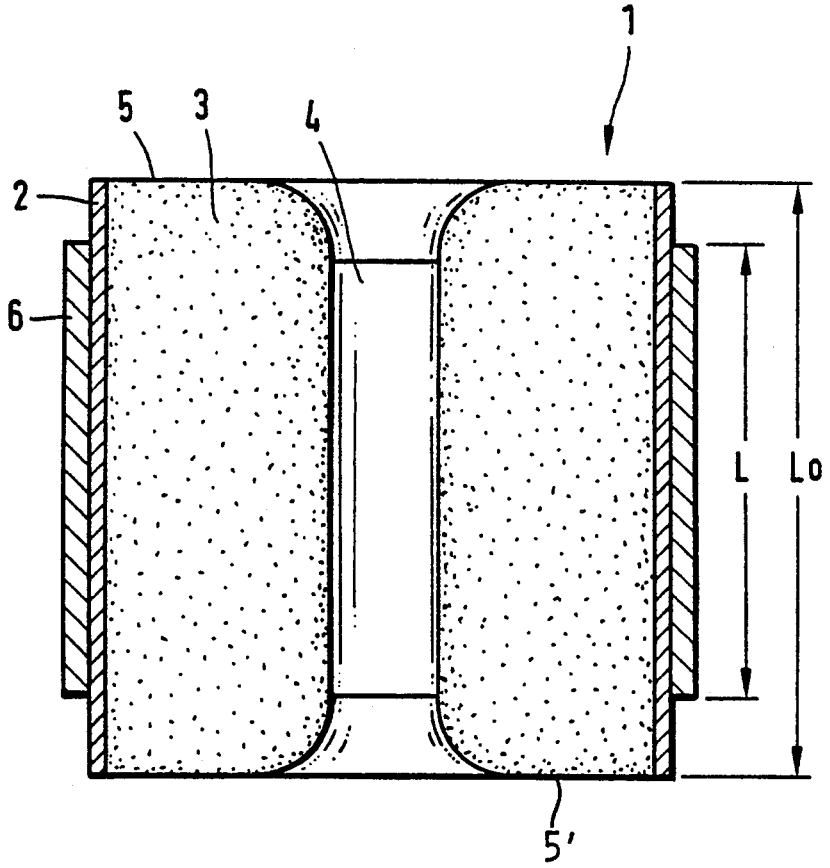
FIG. 1 is a schematic cross-sectional view of a propellant charge module according to the invention.

Referring now to FIG. 1, there is shown a propellant charge module 1 which is essentially composed of a casing 2 of a combustible material that surrounds the propellant charge powder 3. The module is provided with an axial fire-through bore or opening 4. The end surfaces of the propellant charge module 1 are provided with respective covers 5 and 5', for example of paper, etc. An axially displaceable sleeve 6 of a combustible material is disposed on the outer circumferential surface of the casing 2. Preferably sleeve 6 is configured as a wound sleeve, i.e., sleeve 6 is wound from a fiber or fibers of the combustible material in a known manner.

Casing 2 may also be composed of a wound sleeve. The propellant charge powder 3 disposed therein is preferably in a foamed state. This gives casing 2 additional stability. Thus, the wall thickness of wound sleeve 2 can be made relatively thin so that the combustion of casing 2 and sleeve 6 is ensured.

To protect propellant charge module 1 against environmental influences, it may be covered with lacquer on all sides. The lacquer layer (not shown) should be combustible and may contribute to holding sleeve 6 on the casing 2 by effectively gluing the end surfaces of the sleeve 6 to the casing 2.

Figure 2:
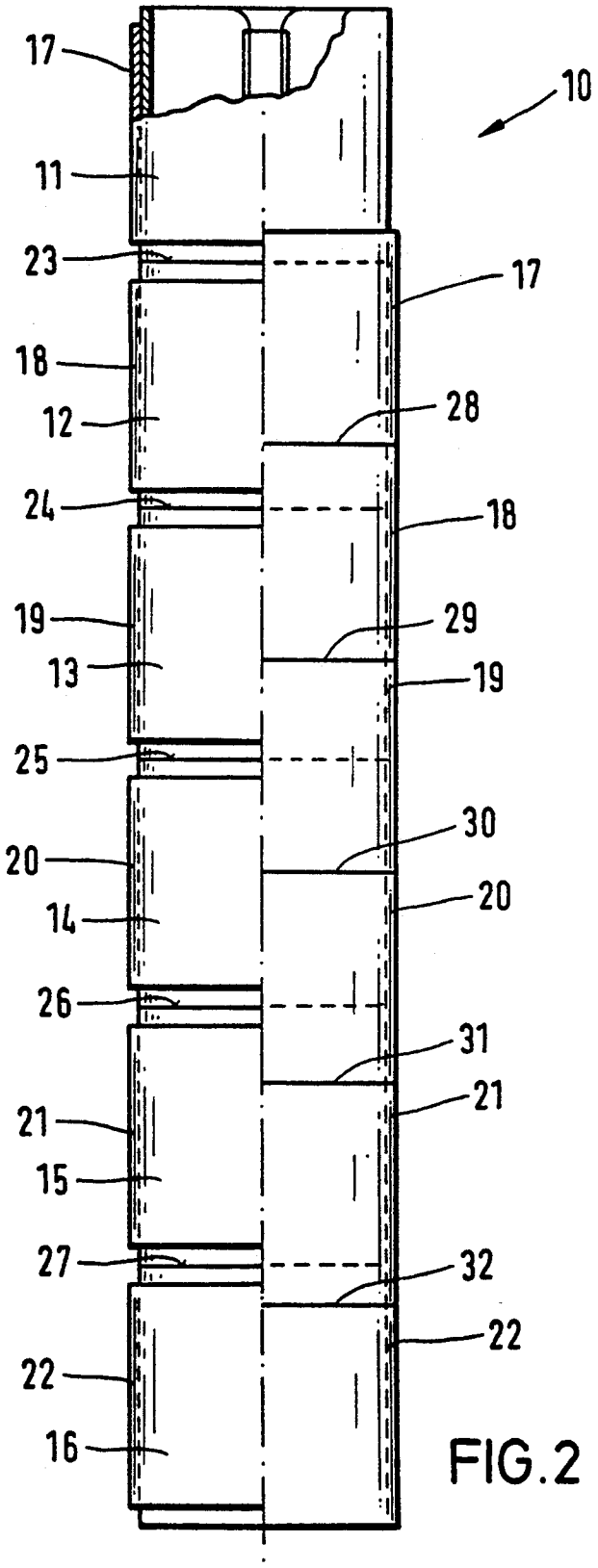
FIG. 2 shows a modular propellant charge according to the invention constructed of six modules according to the invention, with the sleeves being in the starting or non-connecting position of the individual modules on the left and in the assembled or connecting position on the right.

FIG. 2 shows a modular propellant charge 10 composed of six superposed propellant charge modules 11 to 16. On the left side of FIG. 2, the respective sleeves 17 to 22 are shown in their starting position (manufactured position) arranged in the center of the respective casing of the modules 11 to 16. The boundary surfaces between adjacent modules 11 to 16 are marked 23 to 27. With the sleeves 17–22 in this position the modules are not interconnected, i.e. the modular charge 10 is unassembled.

When the modules 11–16 are handled manually for loading etc., the sleeve 17 of the upper module 11 is pushed downward to the extent that sleeve 18 of module 12 therebelow is carried along and then presses onto sleeve 19, etc. Finally, all sleeves 17 to 22 have been axially displaced and no steps remain on the exterior, i.e. the facing end surfaces of adjacent sleeves 17–22 contact one another. Thus, in the illustrated preferred arrangement, the sleeves 17–22 are located at one end of the column of charge modules 13–16. As a result, the entire propellant charge column forms a unit ready for loading wherein adjacent modules are interconnected in that each pair of adjacent modules 11–16 is surrounded in part by a common respective one of the sleeves 17–22 as is shown on the right of FIG. 2. The boundary surfaces of adjacent sleeves 17–22 are given reference numerals 28 to 32.

The length of the respective sleeve 17 to 22 is selected so that adjacent modules 11 to 16 are covered sufficiently to permit interconnection and thus assembly of the modular charge 10. If, as shown in FIG. 1, Lo is the length of a module and N is the number of (identical) modules that can be combined into a modular propellant charge 10, the following relationship applies for the length L of an individual sleeve 6:

$$Lo > L > \frac{N-1}{N} Lo$$

The invention now being fully described, it will be apparent to one of ordinary skill in the art that any changes and modifications can be made thereto without departing from the spirit or scope of the invention as set forth herein.

What is claimed is:

1. A modular propellant charge comprising: a plurality N of cylindrical axially aligned propellant charge modules having a length Lo; a plurality N of displaceable sleeves of a length L, each axially slidably disposed on the exterior surface of at least one of said propellant charge modules with the relationship $$Lo > L > \frac{N-1}{N} Lo$$

applying for the length L; and each adjacent pair of said charge modules is connected together via a respective one of said sleeves which extends over the exterior surface of each of the modules of a said adjacent pair, with facing end surfaces of adjacent said sleeves being are in contact with one another, and with one of said sleeves extending to an end surface of said modular propellant charge.

2. A modular propellant charge as defined in claim 1, wherein said displaceable sleeves of said propellant charge modules are composed of a combustible material.

3. A modular propellant charge as defined in claim 2 wherein said displaceable sleeves of said propellant charge modules are wound sleeves.

4. A modular propellant charge as defined in claim 2, wherein said propellant charge modules include a foamed propellant charge surrounded by a casing which is a wound member of combustible material.

5. A modular propellant charge as defined in claim 4 wherein displaceable sleeves are wound sleeves of a combustible material.

6. A modular propellant charge as defined in claim 1, wherein said sleeves are axially slidable over the entire length of said exterior surface of said modules.

* * * * *